US010801283B2

(12) United States Patent
Prieto et al.

(10) Patent No.: US 10,801,283 B2
(45) Date of Patent: Oct. 13, 2020

(54) MAGNETIC PULSE ACTUATION ARRANGEMENT FOR DOWNHOLE TOOLS AND METHOD

(71) Applicants: Carlos Prieto, Katy, TX (US); Christopher Ryan Hern, Porter, TX (US); Daniel Ewing, Katy, TX (US)

(72) Inventors: Carlos Prieto, Katy, TX (US); Christopher Ryan Hern, Porter, TX (US); Daniel Ewing, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 231 days.

(21) Appl. No.: 15/674,290

(22) Filed: Aug. 10, 2017

(65) Prior Publication Data

US 2018/0045006 A1 Feb. 15, 2018

Related U.S. Application Data

(60) Provisional application No. 62/423,619, filed on Nov. 17, 2016, provisional application No. 62/374,150, filed on Aug. 12, 2016.

(51) Int. Cl.
*E21B 23/00* (2006.01)
*E21B 43/10* (2006.01)
(Continued)

(52) U.S. Cl.
CPC ..... *E21B 23/00* (2013.01); *E21B 43/10* (2013.01); *E21B 17/028* (2013.01); *E21B 31/06* (2013.01); *E21B 33/12* (2013.01); *E21B 43/08* (2013.01)

(58) Field of Classification Search
CPC ..... E21B 17/028; E21B 23/00; E21B 31/06; E21B 33/12; E21B 43/08; E21B 43/10
(Continued)

(56) References Cited

U.S. PATENT DOCUMENTS 3,810,372 A 5/1974 Queyroix
4,255,975 A 3/1981 Debreuille
(Continued)

FOREIGN PATENT DOCUMENTS

GB 1383605 A 2/1974
KR 101529700 B1 6/2015
(Continued)

OTHER PUBLICATIONS

Buckley "An introduction to Eddy Current Testing theory and technology" technical paper eddyc.pdf available from the internet at http://joe.buckley.net/papers; Sep. 8, 2003 (pp. 1-7).
(Continued)

*Primary Examiner* — Kevin J Comber
(74) *Attorney, Agent, or Firm* — Cantor Colburn LLP

(57) ABSTRACT

An arrangement for accelerating a workpiece including a system inductor configured to be supplied a current, a workpiece positioned magnetically proximate to the system inductor, a workpiece inductor associated with the workpiece and configured to magnetically interact with the system inductor. A method for moving a workpiece in a magnetic pressure arrangement comprising increasing inductance of a workpiece subsystem of the arrangement by disposing a workpiece inductor at the workpiece. A method for moving a workpiece in a magnetic pressure system comprising tuning one or more of a resistor, capacitor or inductor of the system to adjust a phase angle of a magnetic pressure produced in the system.

17 Claims, 12 Drawing Sheets

(51) Int. Cl.

| | |
|---|---|
| ***E21B 17/02*** | (2006.01) |
| ***E21B 31/06*** | (2006.01) |
| ***E21B 33/12*** | (2006.01) |
| ***E21B 43/08*** | (2006.01) |

(58) Field of Classification Search
USPC ..... 361/144
See application file for complete search history.

(56) References Cited

U.S. PATENT DOCUMENTS

| | | | |
|---|---|---|---|
| 4,619,127 | A | 10/1986 | Sano et al. |
| 4,825,954 | A | 5/1989 | Baugh |
| 5,030,873 | A | 7/1991 | Owen |
| 5,188,177 | A | 2/1993 | Curry |
| 5,826,320 | A | 10/1998 | Rathke et al. |
| 5,955,934 | A | 9/1999 | Raj |
| 6,474,534 | B2 | 11/2002 | Gabbianelli et al. |
| 7,199,480 | B2 | 4/2007 | Fripp et al. |
| 7,301,429 | B1 | 11/2007 | Hall et al. |
| 8,061,443 | B2 | 11/2011 | Hall et al. |
| 8,662,169 | B2 | 3/2014 | Cortez |
| 9,476,277 | B2 | 10/2016 | Stamatakis |
| 10,227,860 | B1 | 3/2019 | McMullen |
| 2004/0079524 | A1 | 4/2004 | Bass et al. |
| 2004/0084381 | A1 | 5/2004 | Korenev |
| 2004/0084442 | A1 | 5/2004 | Larovere |
| 2004/0263004 | A1 | 12/2004 | Krokoszinski et al. |
| 2005/0097934 | A1 | 5/2005 | Park |
| 2006/0081684 | A1 | 4/2006 | Moore |
| 2006/0131300 | A1 | 6/2006 | Yablochnikov |
| 2008/0061789 | A1 | 3/2008 | Coates et al. |
| 2009/0085701 | A1 | 4/2009 | Veneruso et al. |
| 2009/0166045 | A1 | 7/2009 | Wetzel et al. |
| 2010/0000742 | A1 | 1/2010 | Bonner et al. |
| 2012/0169334 | A1 | 7/2012 | Hopper et al. |
| 2014/0238662 | A1 | 8/2014 | Prieto |
| 2014/0239957 | A1 | 8/2014 | Zhang et al. |
| 2014/0328139 | A1 | 11/2014 | Minto et al. |
| 2015/0159475 | A1 | 6/2015 | Prieto et al. |
| 2015/0308228 | A1 | 10/2015 | Vick, Jr. et al. |
| 2015/0328712 | A1 | 11/2015 | Grubb |
| 2016/0040506 | A1 | 2/2016 | Goodman et al. |
| 2016/0097268 | A1 | 4/2016 | Okoniewski et al. |
| 2016/0175980 | A1 | 6/2016 | Golovashchenko et al. |
| 2017/0266752 | A1 | 9/2017 | Apel et al. |
| 2018/0038972 | A1 | 2/2018 | Gresillon et al. |
| 2018/0043463 | A1 | 2/2018 | Prieto et al. |
| 2018/0045007 | A1 | 2/2018 | Preito et al. |
| 2018/0080296 | A1 | 3/2018 | Prieto et al. |
| 2018/0188413 | A1 | 7/2018 | Capoglu et al. |
| 2019/0249522 | A1 | 8/2019 | Ewing et al. |

FOREIGN PATENT DOCUMENTS

| | | | |
|---|---|---|---|
| WO | 0181021 | A2 | 11/2001 |
| WO | 2007132468 | A1 | 11/2007 |
| WO | 2010135492 | A2 | 11/2010 |

OTHER PUBLICATIONS

Miranda et al. "Magnetic pulse welding on the cutting edge of industrial applications." Soldagem & Inspeção 19.1 (2014): 69-81.
Psyk, et al., "Electromagnetic forming—a review"; Journal of Materials Processing Technology 211 (2011) pp. 787-829.
Arumugam, et al.; "Experimental Study of Electromagnetic Sheet Metal Forming Process", 12th Global Congress on Manufacutring & Management, Procedia Engineering 97 ( 2014) pp. 277-290; 14 pages total.
Bay, et al.; "Electromagnetic forming processes: material behaviour and computational modelling"; 11th International Conference on Technology, Nagoya, Japan; Procedia Engineering 81 ( 2014 ) 793-800, 8 pages total.
Gayakwad, et al.; "A Review on Electromagnetic Forming Process"; 3rd International Conference on Materials Processing and Characterisation; Procedia Materials Science 6 ( 2014) 520-527, 8 pages total.
International Search Report and Written Opinion, dated Nov. 20, 2017, International Appln. No. PCT/US2017/046289, Written Opinion 6 Pages, International Search Report 3 Pages.
Introductory Electromagnetics; Zoya Popović & Branko D. Popović'; Chapter 20—Skin Effects, p. 382-392; Prentice Hall (2000).
Kinsey, et al.; "Electromagnetic forming and Joining of Dissimilar Materials"; I/URC for Metal Deformatin Processes Planning Meeting, Evanston, IL; Mar. 14-15, 2017; 10 pages.
Notification of Transmittal of the International Search Report and the Written Opinion of the International Searching Authority, or the Declaration; PCT/US2017/046296; dated Nov. 22, 2017; 10 pages.
Notification of Transmittal of the International Search Report and the Written Opinion of the International Searching Authority, or the Declaration; PCT/US2017/046298; dated Nov. 22, 2017; 12 pages.
Otin, et al., "A Frequency Domain Approach for Computing the Lorentz Force in Electromagnetic Metal Forming"; International Center for Numerical Methods in Enginnering; 2004-2007; 50 pages.
Otin, et al., "Electromagnetic Metal Forming"; CIMNE—International Center for Numerical Methods in Engineering, Barcelona, Spain; Jul. 2011; 37 pages.
Psyk, et al.; "Process Model and Design for Magnetic Pulse Welding by Tube Expansion"; 5th Internatational Conference on High Speed Forming, 2012; 10 pages.
Senthilnathan, et al.; "A two stage finite element analysis of electromagnetic forming of perforated aluminium sheet metals"; 12th Global Congress on Manufacturing and Management; Procedia Engineering 97 ( 2014) 1135-1144; 10 pages total.
Yu, Haiping; "Effects of current frequency on electromagnetic tube compression"; Journal of Materials Processing Technology, Jan. 2009; 8 pages.
Notification of Transmittal of the International Search Report and the Written Opinion of the International Searching Authority, or the Declaration; PCT/US2017/047507; dated Oct. 31, 2017; 8 pages.

View A'' & B''

MAGNETIC PULSE ACTUATION ARRANGEMENT FOR DOWNHOLE TOOLS AND METHOD

CROSS REFERENCE TO RELATED APPLICATIONS

This application claims the benefit of an earlier filing date from U.S. Provisional Application Ser. No. 62/423,619 filed on Nov. 17, 2016, which claims priority to U.S. Provisional Application Ser. No. 62/374,150 filed Aug. 12, 2016, the entire disclosure of which is incorporated herein by reference.

BACKGROUND

In the resource recovery industry (such as hydrocarbons, steam, minerals, water, metals, etc.) resources are often recovered from boreholes in formations containing the targeted resource. A plethora of tools are used in such operations, many of them needing to be actuated remotely. While early actuation configurations comprised mechanical connections only, more recent configurations employ chemical, electrical and mechanical means as well as combinations thereof. The industry has many available configurations and methods but due to evolving conditions and recovery concepts, the industry is always in search of alternate configurations and methods to actuate the various tools that are used.

SUMMARY

An arrangement for accelerating a workpiece including a system inductor configured to be supplied a current, a workpiece positioned magnetically proximate to the system inductor, a workpiece inductor associated with the workpiece and configured to magnetically interact with the system inductor.

A method for moving a workpiece in a magnetic pressure arrangement including increasing inductance of a workpiece subsystem of the arrangement by disposing a workpiece inductor at the workpiece.

A method for moving a workpiece in a magnetic pressure system including tuning one or more of a resistor, capacitor or inductor of the system to adjust a phase angle of a magnetic pressure produced in the system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

In connection with the present disclosure, applicant's use of the term "pulse" relates to a magnetic field that is rapidly formed and will accelerate a workpiece to a minimum contact velocity of 200 meters per second for welding or, if welding is not required, to accelerate the workpiece to any velocity in order move the workpiece in any desired direction wherein the term "pulse" itself is defined by its ability to cause the workpiece to achieve the minimum velocity stated for an unspecified period of time and by ensuring an excitation pulse frequency range is within −50% to 250% of the natural frequency of the workpiece to be accelerated. Various actuations described herein are achievable using the pulse as defined for differing lengths of time such as installing a tool in the downhole environment, moving a portion of a tool (moving the workpiece), etc.

Generally applicable to all of the embodiments hereof, the pulse occurs pursuant to the use of an inductor attached to a capacitor bank that itself may be attached to a power source for recharging. Release of a high amplitude and high frequency current as the pulse defined above from the capacitor bank at a selected time generates a high-density magnetic field pulse that is coupled to a workpiece placed in the vicinity thereof. An eddy current will consequently be produced in the workpiece with a field orientation that opposes the current induced field hence providing a magnetic pressure that is capable of accelerating the workpiece in a direction. Duration and magnitude of a given pulse equates to distance of movement for a given system or stated alternately, the amount of work imparted in a given system. The rate that the work is applied to the system will result in the desired deformation of the workpiece where the deformation can be simple expansion or collapse or joining of the workpiece to a desired object.

Figure 1:
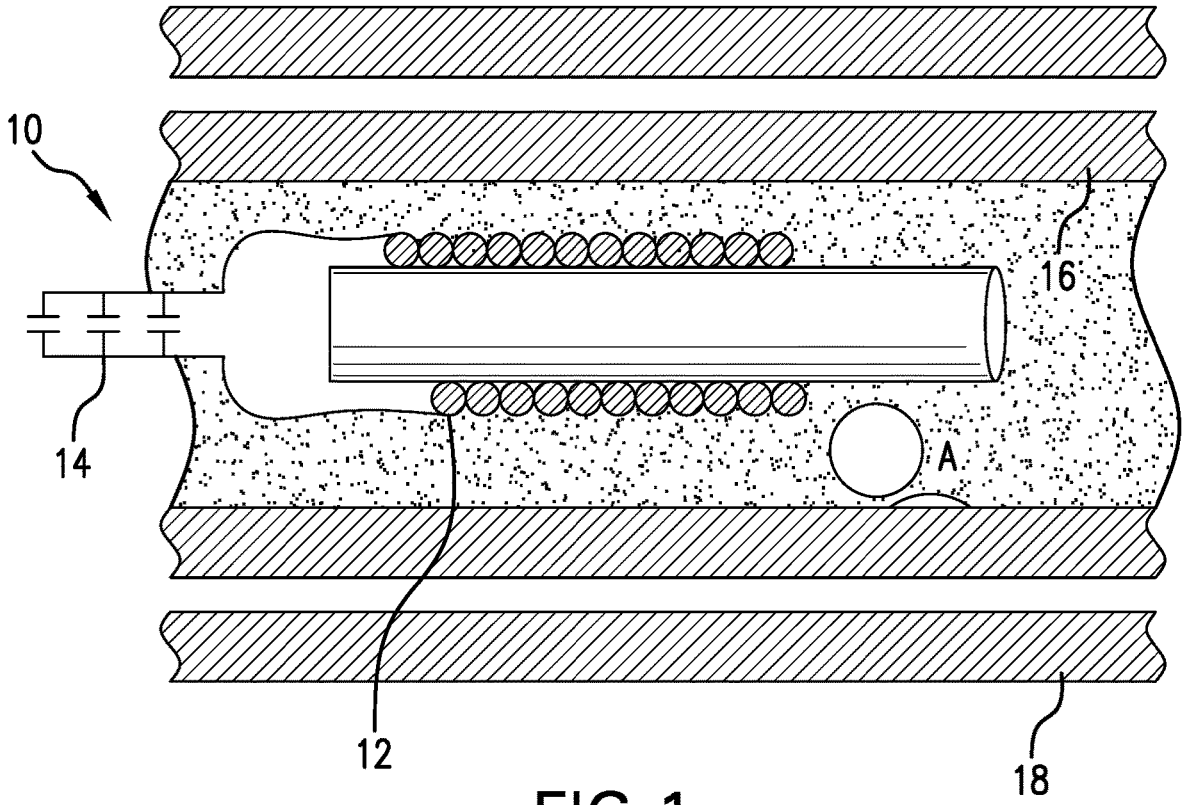
FIG. 1 is a cross sectional view of a magnetic pulse actuation arrangement illustrating such as liner hanger or casing patch installation.

Referring to FIG. 1, one embodiment of a magnetic pulse actuation arrangement 10 is illustrated. The arrangement includes an inductor 12 fed by an energy source 14 which may be a battery, umbilical line, generator, capacitor, etc. If a capacitor 14 is used, it may be a source of electrical energy or may be used to condition electrical energy from another source such as a battery (not shown) or cable from a more remote location (not shown). A workpiece 16 is disposed near the inductor 12 such that a magnetic field produced by the inductor is coupled to the workpiece 16 generating a magnetic pulse to move the workpiece. The magnitude of the magnetic pulse is proportionally related to the current applied to the inductor. The velocity of movement of the workpiece under the influence of the magnetic pulse is, as noted above, at a minimum contact velocity of 200 meters per second for welding.

Movement of the workpiece is adjustable from merely a positional change without impacting another structure, to an impact with another structure 18 such as a casing in FIG. 1 at such velocity that plastic deformation of the workpiece 16 occurs at an energy level where a weld is formed between the workpiece 16 and the structure 18. Careful control of the duration and amplitude of the magnetic pulse allows control of whether the movement will produce a change in position toward another structure, a change in position to contact the other structure 18 such that fluid flow is impeded but fluid passage is not prevented, a change in position sufficient to produce a pressure seal without a weld (the degree of pressure seal required will be dependent upon the anticipated pressure differential that is desired) or a change in position where a fully welded interface is created by an impact sufficient to cause a material jet and a solid state weld. The pressure seal can also be enhanced by an elastomer or other material with higher poisons ratio than the deformed body.

Movement may be in a directly radial direction whether inwardly or outwardly or movement may be directed axially or in any other direction selected and in which direction the pulse may be directed. As shown in the depiction of FIG. 1, movement is radially outwardly directed. Movement directed radially is suitable for installing a number of downhole tools that utilize radial displacement such as liner hangers or casing patches (suitably illustrated in generic FIG. 1) where the workpiece is a liner hanger, casing patch, screens, fishing tools, collars, couplings, anchors, ball seats, plugs (frac plugs, bridge plugs, packers), etc. Representative illustrations for some of these follow.

Figure 2:
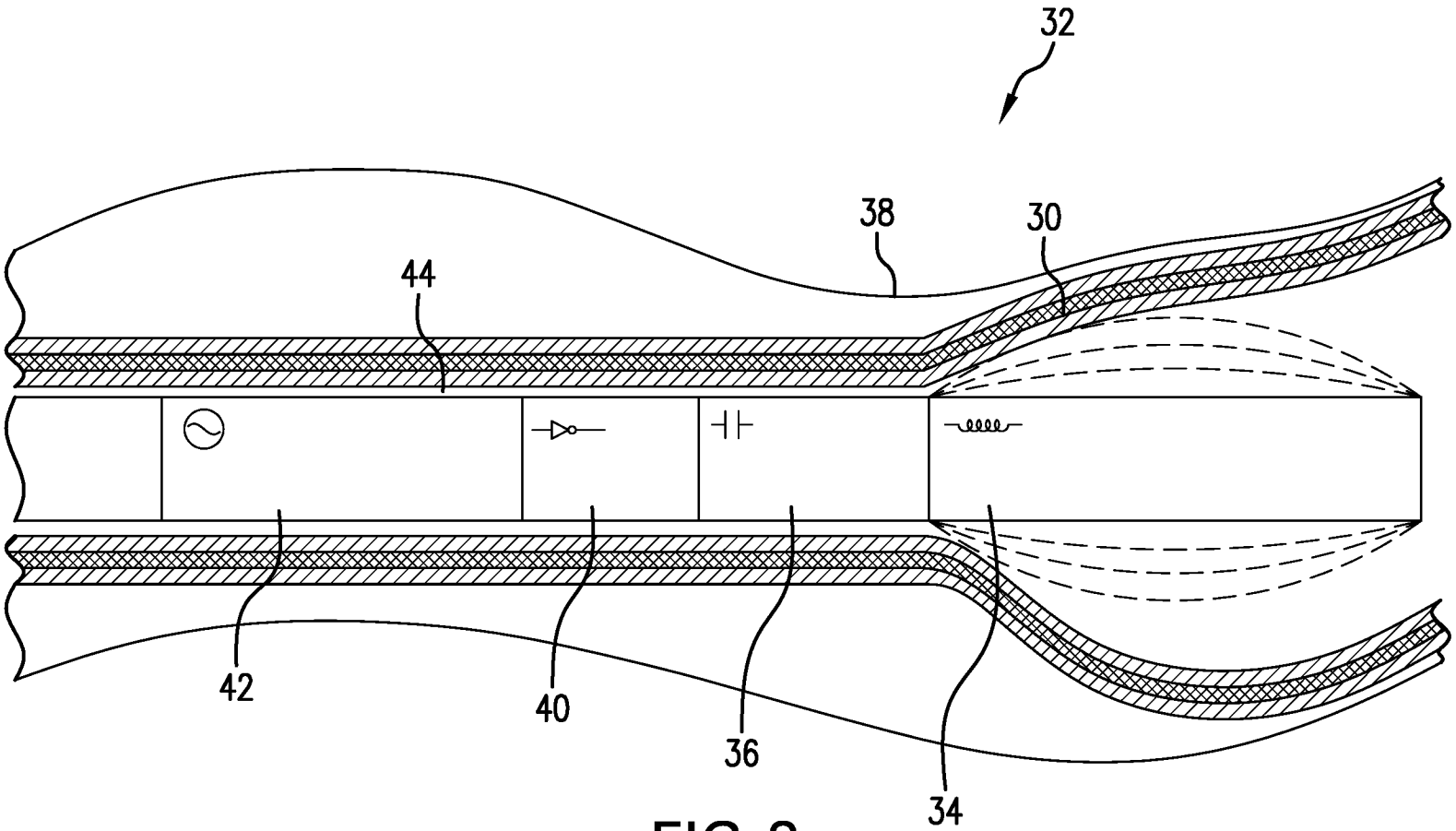
FIG. 2 is another cross sectional view of a magnetic pulse actuation arrangement illustrating a screen installation.

Referring to FIG. 2, a view of a portion of a borehole with a screen 30 disposed about an actuator 32 similar to the layout of FIG. 1 including the source and the inductor is schematically shown. Screen 30 (either with or without inner and or outer shrouds) is accelerated radially outwardly by magnetic pulse occasioned by inductor 34, powered by energy source 36. The screen 30 may be moved into contact with the borehole wall 38 to function as is known for a screen. The actuator of FIG. 2, may also include an inverter 40 and source 42 as shown. The actuator 32 may be positioned and moved about in the borehole on a workstring 44. In use, the workstring will be positioned, the actuator initiated and then the workstring moved to a next segment of screen 30 to be moved.

Figure 3:
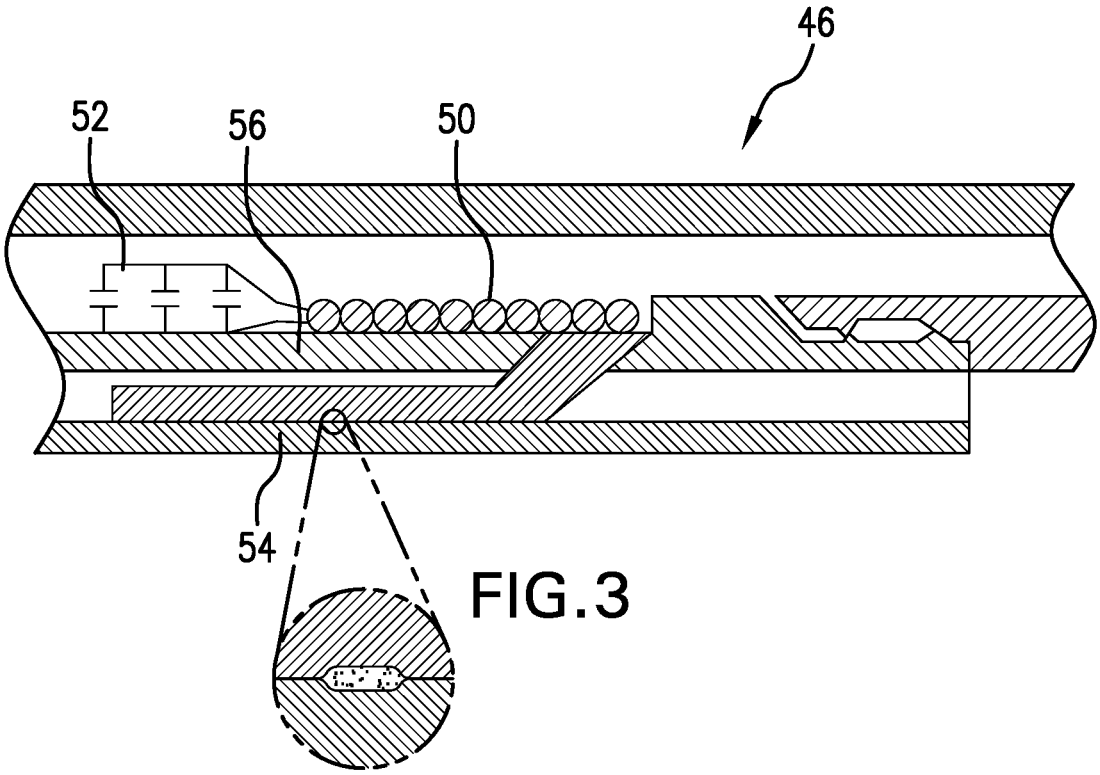
FIG. 3 is another cross sectional view of a magnetic pulse actuation arrangement illustrating a fishing arrangement.
Figure 4:
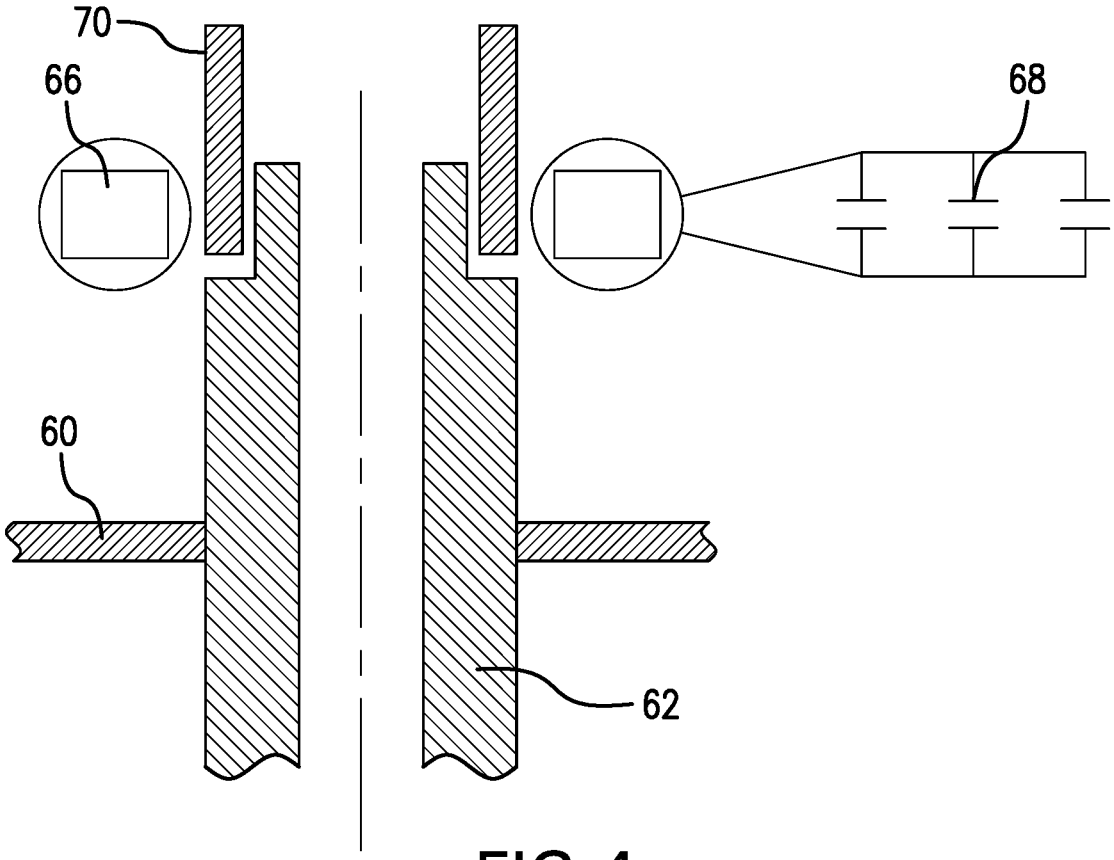
FIG. 4 is another cross sectional view of a magnetic pulse actuation arrangement illustrating a joint coupling arrangement.

Referring to FIG. 3, the actuator concept disclosed herein is illustrated in connection with a fishing operation. Specifically, actuator 46 is configured at an end of a fishing tool 48 to be run proximately to a fish 54 to be retrieved. Recognizable from the above discussion is inductor 50 and capacitor 52. The actuator 46 is initiated, resulting in a workpiece 56 being moved into forcible contact with the fish 54 (and in some embodiments welded thereto). The fish may then be retrieved. As will be understood by one of ordinary skill in the art, some fishing operations place the fishing tool on the ID (inside diameter) of the fish rather than on the OD (outside diameter) of the fish as illustrated in FIG. 3. If the casing were illustrated on the opposite side of the components (i.e. where the centerline is presently illustrated) in FIG. 3, the illustration would be that of an ID fishing tool. In other respects the operation is identical. Referring to FIG. 4, a schematic cross section view of a coupling operation is illustrated. A rig floor 60 is shown about a tubular 62 being advanced into the hole. A magnetic pulse actuator 64 includes an inductor 66 powered by a capacitor 68 similar to FIG. 1 that is positioned about a workpiece 70, which in this iteration is a coupling to connect sequential tubulars together to create a string. The magnetic pulse accelerates the coupling 70 into contact with the tubular 62 at sufficient velocity to create a connection, whether that be merely an interference fit or a weld as desired by the operator.

Figure 5:
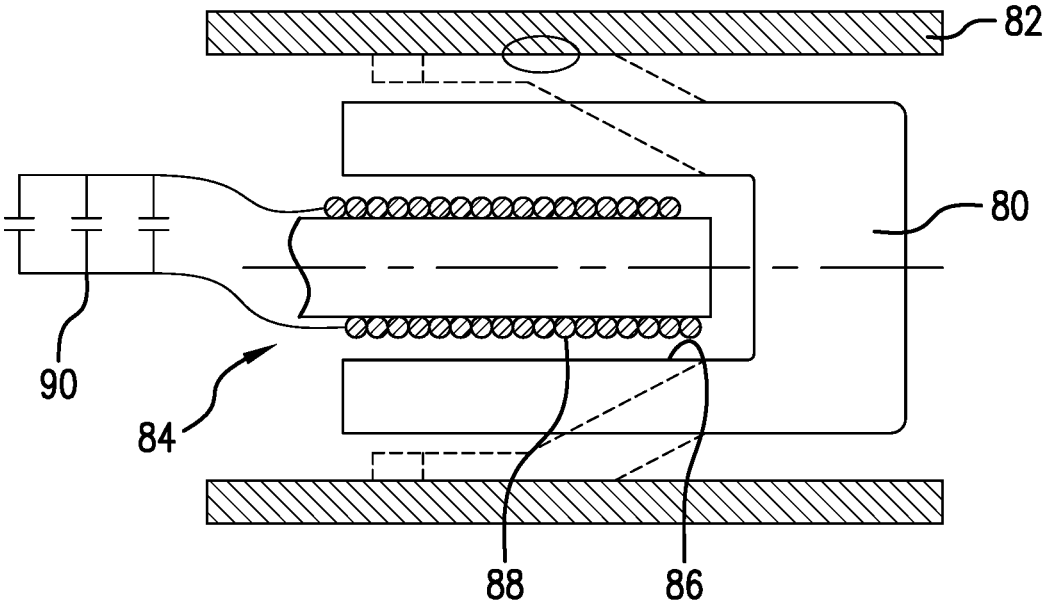
FIG. 5 is another cross sectional view of a magnetic pulse actuation arrangement illustrating a plug installation.

In another embodiment, referring to FIG. 5, a plug 80 is installed in a borehole or casing 82, etc. As illustrated, a plug 80 is positioned at a desired location in the casing 82 either with an actuator 84 in place or in a prior run. The plug 80 is configured with a central recess 86 within which an inductor 88 is placed. The inductor is powered by an energy source 90. Upon creation of the magnetic pulse as described above, the plug 80 is deformed into contact with the casing 82, illustrated in phantom lines in FIG. 5. The degree to which the plug 80 is urged into contact with the casing 82 is similar to the foregoing embodiments in that the duration of the magnetic pulse may be selected to cause the plug 80 to merely make contact with the casing 82, become frictionally engaged, become frictionally locked, or become welded/bonded to the casing, the last iteration providing the most secure plugging of the borehole.

Figure 6:
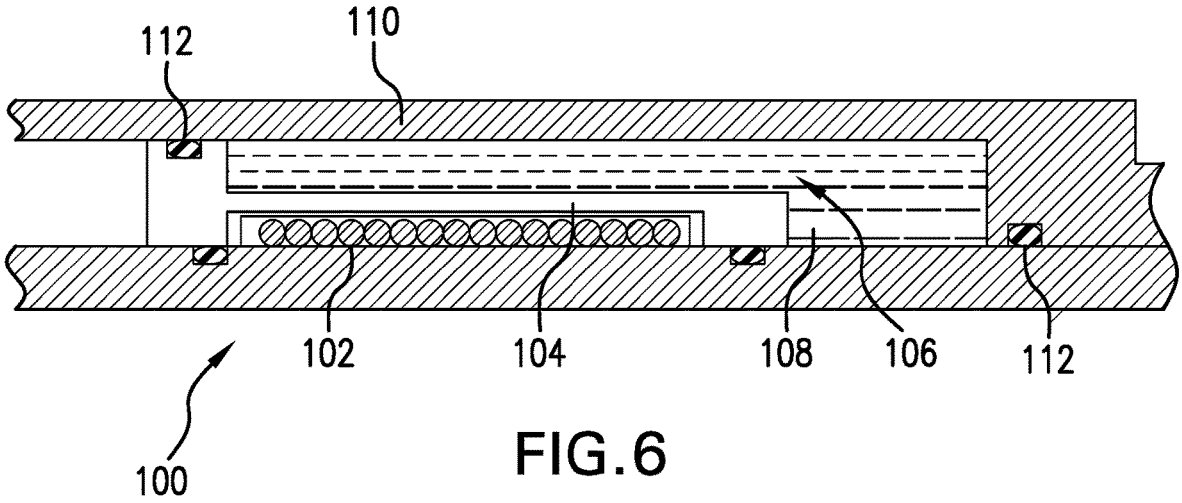
FIG. 6 is an embodiment of magnetic pulse actuation arrangement illustrating axial movement.

Referring to FIG. 6, another embodiment that creates axial movement is illustrated. In this embodiment the magnetic pulse is created in a radial direction like in many of the foregoing embodiments but uses that radial movement to modify a chamber volume to actuate hydraulically in a desired direction. The actuator 100 includes an inductor 102 similar to the foregoing. The inductor is positioned adjacent a workpiece 104 that may be a tubular or just a portion of a chamber 106. Deformation of the workpiece 104 due to magnetic pulse causes the chamber to change volume causing fluid 108 therein to be compressed. In an embodiment the fluid therein is substantially incompressible and hence the energy associated with the deformation must be reacted somewhere. In the illustration, the somewhere is movement of the outer sleeve 110. Due to seals 112 (which may be o-rings), the fluid 108 cannot escape chamber 106. Accordingly chamber 106 must growth in some direction proportionally to the size reduction of chamber 106 due to the workpiece 104 movement. In the illustrated case, the movement is an elongation that is provided by outer sleeve 110 moving to the right in the figure. That movement is axial and useful for actuating whatever tool is desired to be actuated by an axial movement such as a packer, a sleeve, etc.

Figure 7:
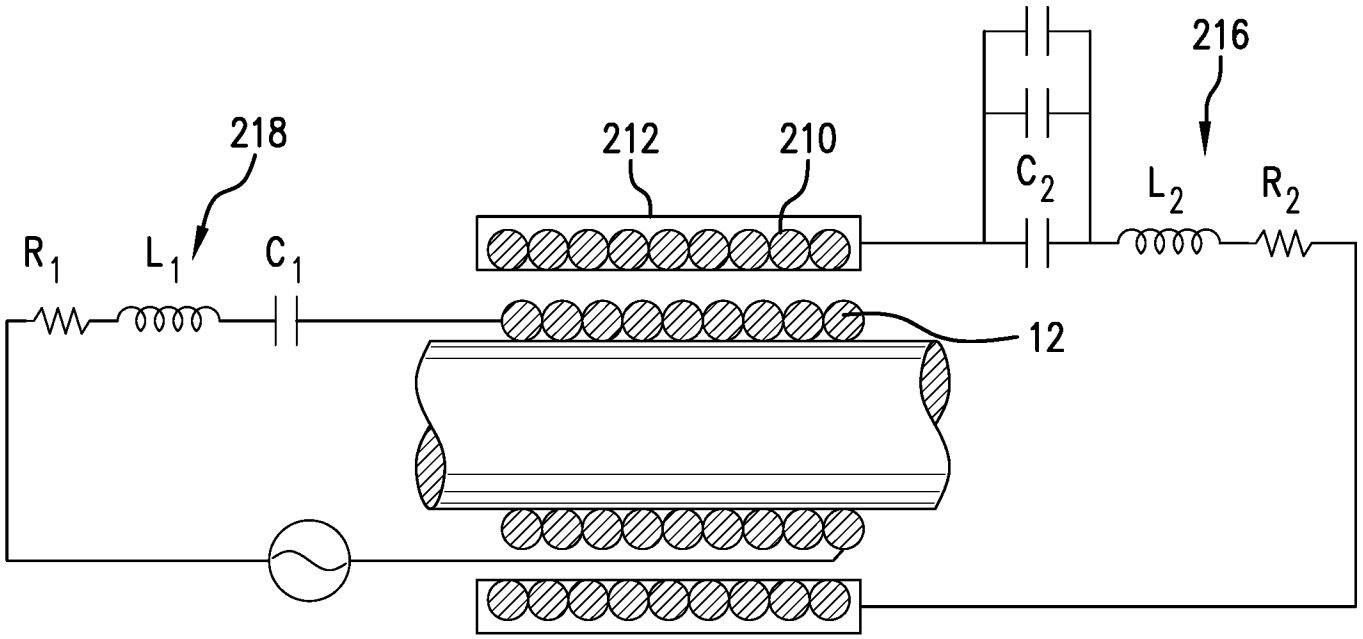
FIG. 7 is a schematic representation of magnetic pulse actuation arrangement that employs a workpiece subsystem.

Referring to FIG. 7, an alternate arrangement is illustrated that may be applied to any of the embodiments discussed herein. It is to be understood that the alternate embodiments use all of the components discussed above and add new components discussed hereunder. For clarity, it is to be appreciated that where the inductor 12 from above is addressed hereafter, that inductor is now termed "system inductor" to distinguish it from newly added components. A system 200, which as noted includes the above, additionally includes a workpiece inductor 210 disposed upon the workpiece 212 of the system 200. For clarity, the term "workpiece subsystem 217" will be used when referring to the combination of components comprising workpiece inductor 210, workpiece 212 and optionally a circuit 216 (described below). It is also to be understood that because of the addition of the workpiece inductor 210, an additional benefit is that the workpiece itself may be formed of a material (e.g.

polymers, ceramics, nonmagnetic and/or nonconductive composites or metals, etc.) that is not magnetically affected by a magnetic field. In such a case, the movement of the workpiece results from movement of the workpiece inductor. It has been determined by the inventors hereof that the inductance of each of the workpieces discussed above is very small and that the small inductance causes the operating frequencies required to generate the desired magnetic field to be quite high. In order to reduce the operating frequencies needed, thereby reducing cost and increasing ubiquity of generators available for the task, the inductances of the workpiece subsystem are herein raised by disposing the workpiece inductor 210 (and the circuit 216) in operable communication with the workpiece 212. More specifically, the workpiece inductor 210 (insulated, encapsulated or not) is in contact with the workpiece 212, embedded in the workpiece 212 or sufficiently proximate the workpiece 212 such that the inductance of the workpiece 212, because of the proximity of the workpiece inductor 210 is substantially higher than it would be without the workpiece inductor 210, so that the purpose of the invention is realized. Proximity should be understood to mean that stresses imparted to the workpiece inductor will be transferred to the workpiece in addition to or separate from the magnetic load imparted to the workpiece directly.

The workpiece inductor 210 may be passive or active with respect to whether or not a current is supplied thereto but in any event, the workpiece inductor 210 is, in some embodiments, a part of a circuit 216 which may be an RLC (resistor-inductor-capacitor) or an RL circuit (where a capacitor is not employed) or an RC circuit (where no additional inductor is employed). An RL circuit can of course be realized without additional components since as will be appreciated, the workpiece inductor 210 itself supplies both resistance and inductance but additional inductors and/or resistors and/or capacitors allow additional tuning of the system. In other embodiments, other components such as resistors and/or inductors and/or capacitors in the circuit allow for greater specificity in tuning the circuit (adjusting natural frequency) by varying the values of one or more of these components. For example, as one of skill in the art of power transmission will recognize, a phase angle shifted due to a high inductance load, can be rectified between voltage and current through use of capacitor(s) on the grid. Calculating the effect on natural frequency of each component added to the system can be done with the equation for an RLC circuit:

$$\lambda_n=(1/L*C)^{0.5}$$

Each component of the calculation is the total equivalent value for the total circuit. $\lambda_n$ is the natural frequency of the circuit, L is the total inductance of the circuit, and C is the total capacitance of the circuit. The total value of the circuit components can be driven by capacitors and/or inductors hooked together in series or parallel. Having both options will allow for a wide range of frequencies to be achieved as well as tuning the circuit very finely. The addition of the RLC 216 and workpiece inductor 210 for the workpiece 212 in each of the configurations above reduces optimal resonance frequencies from about 24000 Hz to about 0-600 Hz. Generators for operating frequencies greater than 0 and up to about 600 Hz range are ubiquitous and inexpensive off the shelf items. In one example, the system uses 5000 volts oscillating at frequencies below 200 Hz. Generally, a total equivalence capacitance of ~0.0002 Farad and a total equivalent inductance of 0.0002 Henries will produce a 600 Hz natural frequency (Natural Frequency=(1/Inductance*Capacitance)^0.5). And while operating frequency requirements are substantially lower for embodiments using the system illustrated in FIG. 7, they all continue to benefit from the magnetic pressure discussed previously and the functional characteristics noted generally herein.

Further, it is also contemplated to add an RL and RLC or RC circuit 218 to the inductor 12 discussed above to further tune the system including adjusting frequencies of both circuits. With greater capacitance and inductance, lower natural frequencies on the system inductor and hence lower operating frequencies are achieved.

Figure 8:
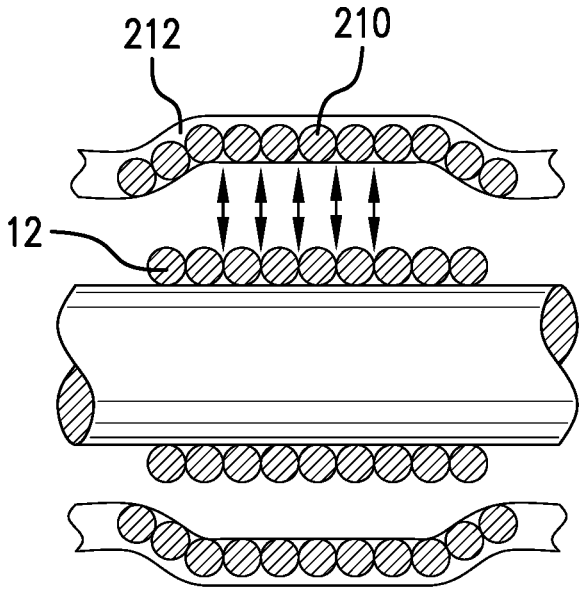
FIG. 8 illustrates a burst direction effect.
Figure 9:
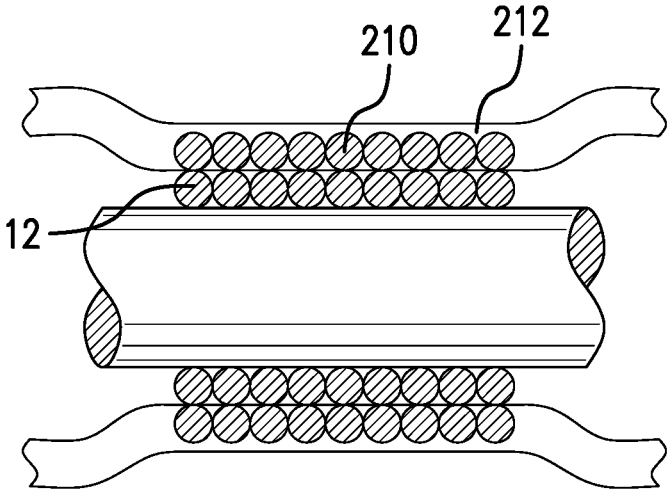
FIG. 9 illustrated a collapse direction effect.
Figure 10:
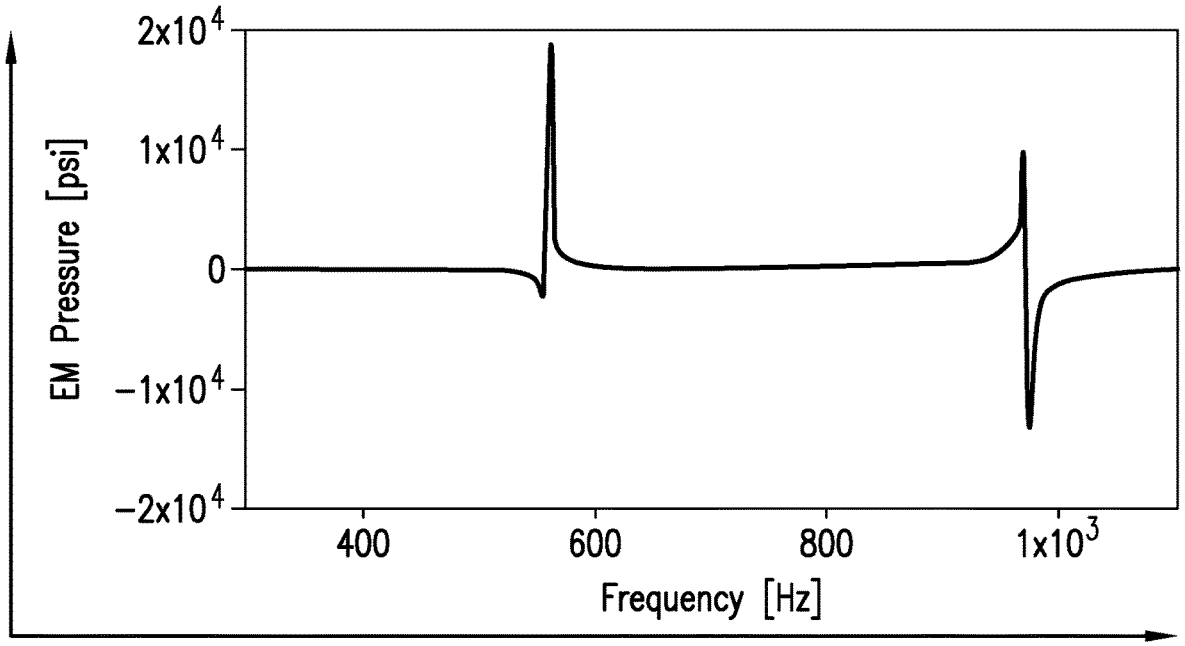
FIG. 10 is a chart illustrating magnetic pressure and phase angles.

Referring to FIGS. 8 and 9 together, the addition of the circuit 216 and workpiece inductor 210 for the workpiece 212 in each of the configurations also allows adjustment of the phase angle of the resulting field such that the workpiece may be subjected to burst force (FIG. 8) or collapse force (FIG. 9) as desired. As non-limiting examples, the former might act to set a liner while the latter might act to grab a fish. Referring to FIG. 10, a modeling curve illustrates this point where the total inductance is 0.00672 Farads for the workpiece circuit. An excitation pulse frequency range within −50% to 250% of the natural frequency of the workpiece to be accelerated is useful not only for the embodiments as discussed above for large amplitude positive phase angle pressures but also is useful for large amplitude pressures having a negative phase angle thereby enabling the collapse force embodiments. Selecting the capacitance in the circuit 216 allows selection of a negative pressure signal between the inductors. An example of an embodiment having a negative phase angle requires that capacitance be other than zero.

It is to be appreciated for all embodiments described or alluded to above that the generated magnetic pressure may be generated more than once for a particular movement operation. Specifically, the energy source, be it capacitor, battery, umbilical line, generator, etc. may release the energy to the inductor(s) multiple times in succession, which may be quite rapid or more slowly delivered to provide magnetic pressure over a period of time rather than in one single burst. This is beneficial in some instances.

Figure 11:
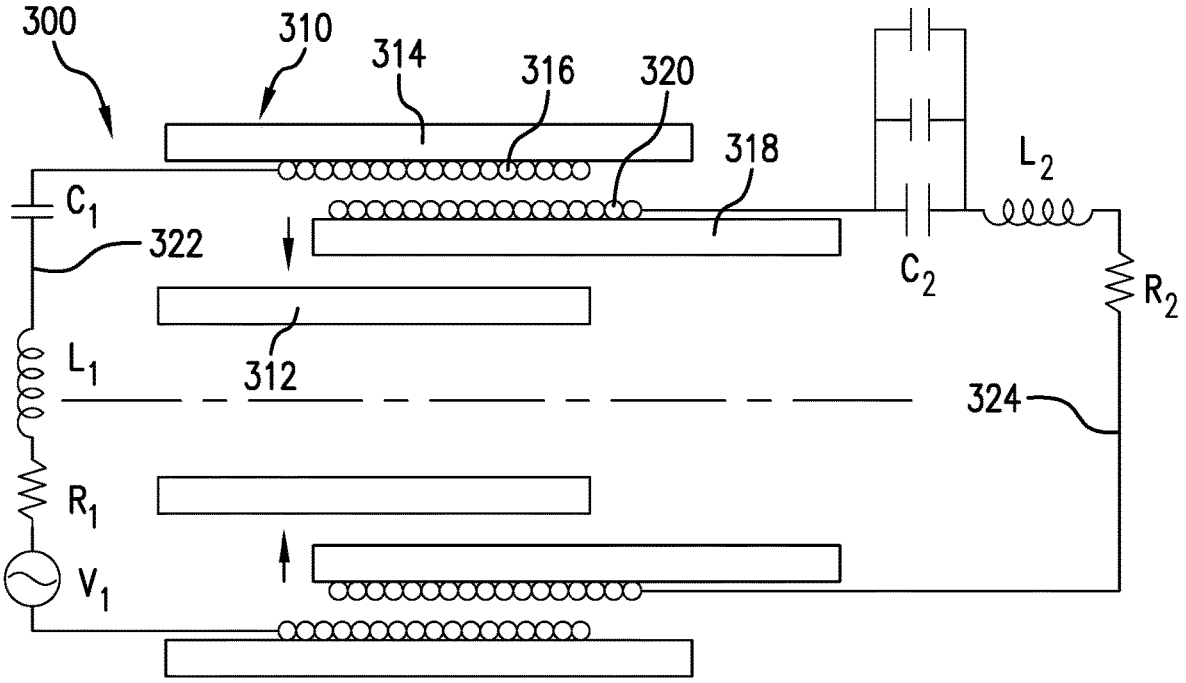
FIG. 11 is another cross sectional view of an overshot embodiment.

Referring to FIG. 11, an overshot system 300 is illustrated. In this system, an overshot tool 310 comprising a mandrel 312 and an overshot tubular 314 having a system inductor 316 disposed radially inwardly of the overshot tubular 314. A workpiece 318 includes a workpiece inductor 320 disposed radially outwardly of the workpiece 318. Generally, it is the system inductor 316 that would be preferentially powered but it is to be appreciated that the workpiece inductor 320 could substitutionally be powered or, of course, both could be powered as is illustrated. In iterations, the circuit connected to the system inductor 316 and/or the workpiece inductor may be an RLC circuit (322 or 324) or other combinations discussed above regardless of whether the particular circuit is powered or passive. The system 300 as illustrated is configured to accelerate the workpiece into contact with the mandrel 312 to at least create a frictional engagement, and if the workpiece 318 is accelerated to a minimum of 200 m/s at the point of contact with the mandrel 312, then a weld will be formed. In either case, the mandrel, post magnetic pulse, is used to withdraw the workpiece 318 from its immediately preceding position.

Figure 12:
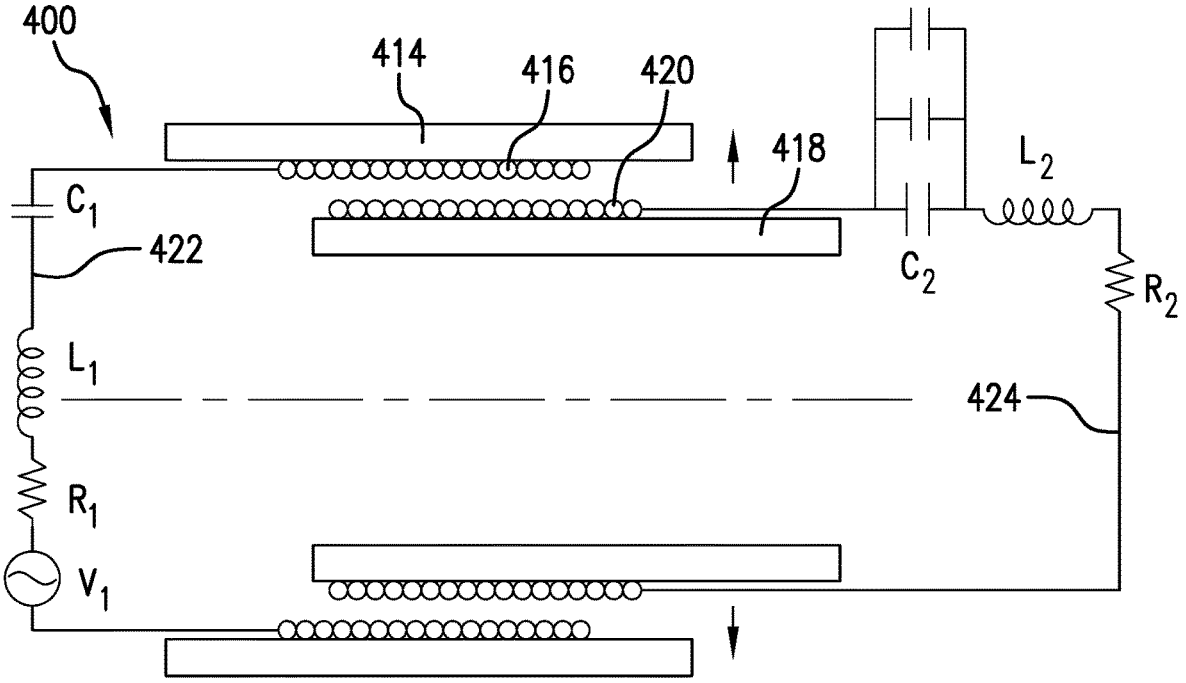
FIG. 12 is another cross sectional view similar to FIG. 11 but without a mandrel and configured for a negative pressure pulse.

Alternatively, referring to FIG. 12, another overshot system 400 that is similar to that discussed with reference to FIG. 11 and therefore will employ 400 series numerals for like components, is distinct in that there is no mandrel as there was in FIG. 11. The other distinction is that the system 400 is configured for a negative phase angle that will bring the workpiece 418 into contact with the overshot tubular 414. The overshot tubular 414 is then able to move the workpiece 418 from its immediately preceding position. Other 400 series numerals employed in the figure are the same componentry as in FIG. 11 but for the reversal of the phase angle.

Figure 14:
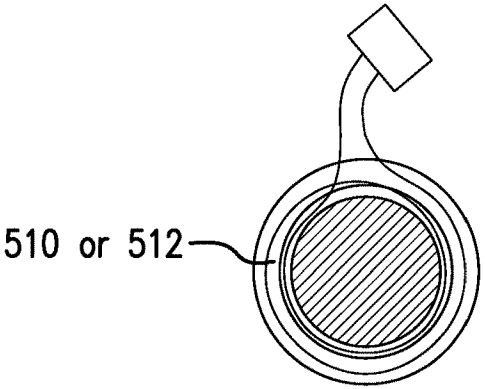
FIG. 14 is an end view of components of FIG. 13 taken along lines 14-14.
Figure 13:
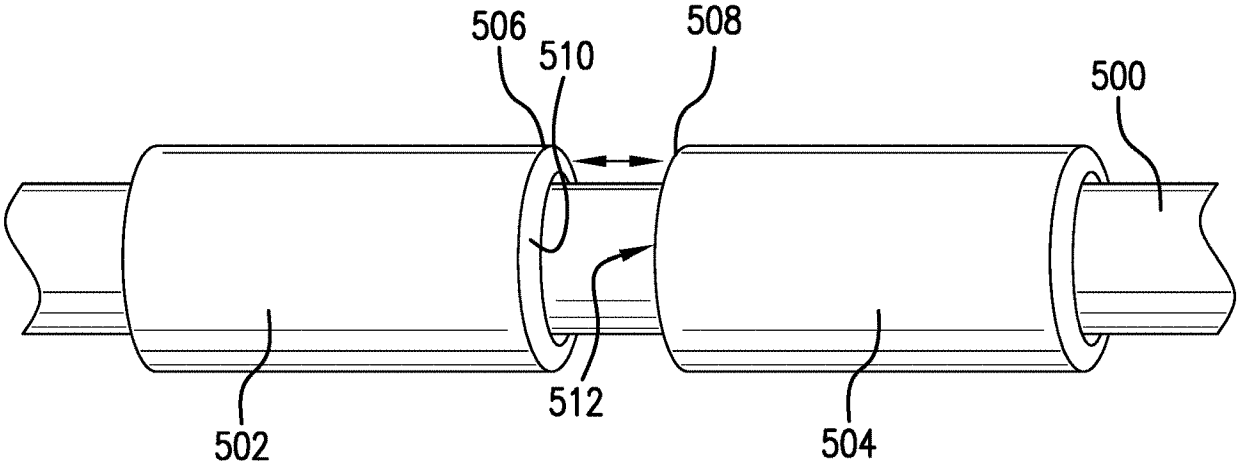
FIG. 13 is another alternate embodiment of an axial moving configuration.
Figure 13:
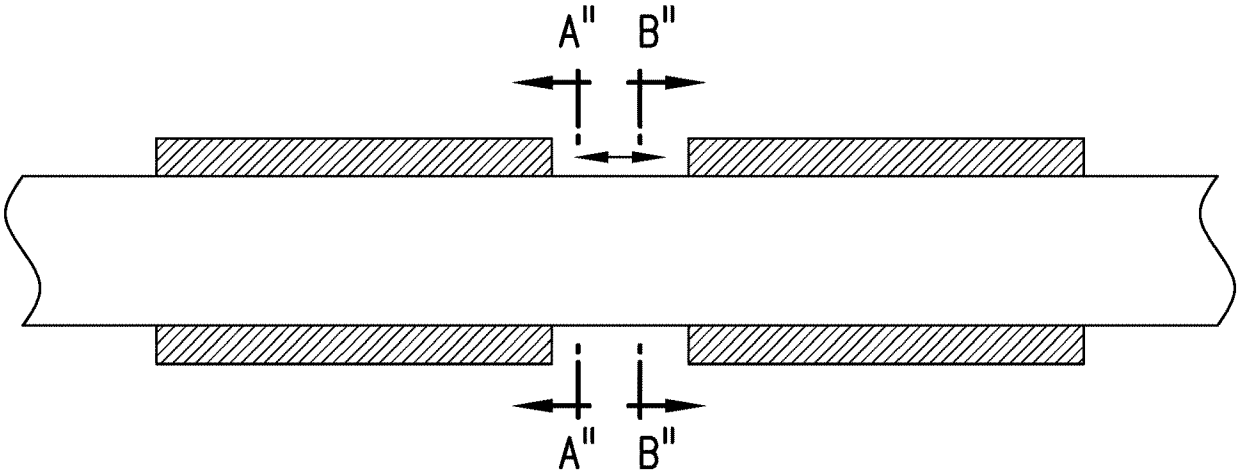

Referring to FIGS. 13 and 14, another alternate embodiment is illustrated wherein axial movement is generated. In the schematic illustration, a mandrel 500 supports a first sleeve 502 and a second sleeve 504. One or both of the sleeves 502 and 504 will be movable on the mandrel 500. At an end 506 of sleeve 502 and end 508 of sleeve 504 is situated one or both of coils 510 and 512. The coils can be seen in FIG. 14, which looks the same in both of the coils 510 and 512 assuming both are used in the particular iteraction. One or both of these are similar to the system and workpiece inductors described above and hence are powered or not through appropriate RLC RL or RC circuits. The description of how the system works is the same as above with the distinction being direction of movement of the workpiece, or in this case the first or second sleeve 502,504. The movement will be axial and so the illustration makes plain one configuration for causing axial as opposed to radial movement, which action most of the previous embodiments (but not all) are directed.

Figure 15A:
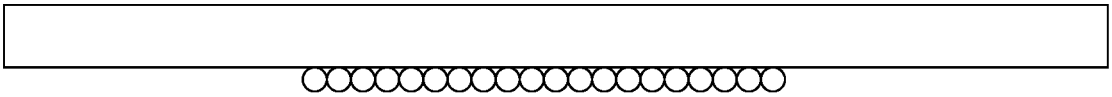
FIGS. 15A-E are a collection of alternate positions for an inductor relative to a component with which that inductor is operationally associated.
Figure 15B:
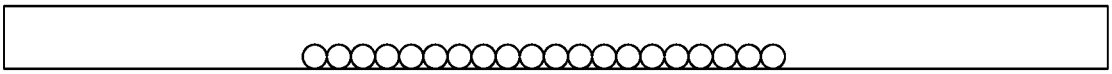
Figure 15C:
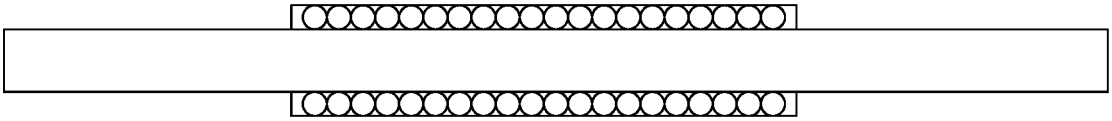
Figure 15D:
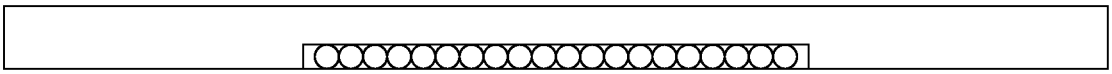
Figure 15E:
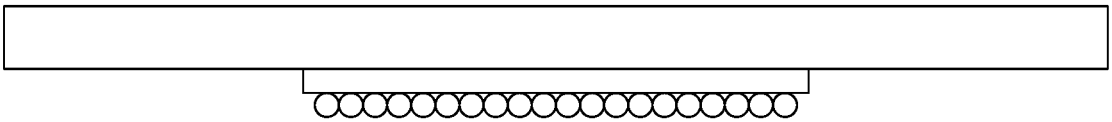

In order to avoid any lack of understanding, it is to be appreciated that the inductors, whether system or workpiece or both, may be disposed at, on, in, around, on another piece adjacent the subject component (or any other descriptor) the component with which they are associated (see for exemplary illustrations FIG. 15A coil attached directly to component; FIG. 15B coil embedded in the component; FIG. 15C coil embedded in a piece attached to the component; FIG. 15D coil housed in a pocket or recess in the component; FIG. 15E coil attached directly to a piece that is attached to the component.). For example, a workpiece inductor might be embedded in the workpiece, might be wrapped around the workpiece, might be within confines of the workpiece, etc. The point is that the inductor needs to be positioned relative to a component it is intended to affect such that a magnetic field produced by the inductor will have the intended effect. For example, the inductor field needs to result in the desired deformation of the workpiece where the deformation can be simple expansion or collapse or joining of the workpiece to a desired object.

Set forth below are some embodiments of the foregoing disclosure:

Embodiment 1: An arrangement for accelerating a workpiece including a system inductor configured to be supplied a current, a workpiece positioned magnetically proximate to the system inductor, a workpiece inductor associated with the workpiece and configured to magnetically interact with the system inductor.

Embodiment 2: The arrangement as in any prior embodiment wherein the workpiece inductor is configured with an RLC or RL or RC circuit to form a workpiece subsystem.

Embodiment 3: The arrangement as in any prior embodiment wherein the RLC or RL or RC is passive.

Embodiment 4: The arrangement as in any prior embodiment wherein the RLC or RL or RC is powered.

Embodiment 5: The arrangement as in any prior embodiment wherein the system inductor is configured with an RLC or RL or RC circuit.

Embodiment 6: The arrangement as in any prior embodiment wherein the workpiece inductor increases inductance of the workpiece subsystem.

Embodiment 7: The arrangement as in any prior embodiment wherein the workpiece is a downhole tool.

Embodiment 8: The arrangement as in any prior embodiment wherein the downhole tool is one of a liner hanger, casing patch, screen, fishing tool, collar, coupling, anchor, ball seat, frac plug, bridge plug and packer.

Embodiment 9: The arrangement as in any prior embodiment wherein the workpiece is positioned relative to the system inductor to move radially.

Embodiment 10: The arrangement as in any prior embodiment wherein the workpiece is positioned relative to the system inductor to move axially.

Embodiment 11: A method for moving a workpiece in a magnetic pressure arrangement comprising increasing inductance of a workpiece subsystem of the arrangement by disposing a workpiece inductor at the workpiece.

Embodiment 12: The method as in any prior embodiment further including adjusting a natural frequency of the workpiece subsystem by changing one or more of capacitance, resistance or inductance of an RLC or RL or RC circuit electrically connected with the workpiece subsystem.

Embodiment 13: The method as in any prior embodiment further including adding an RLC or RL or RC circuit to a system inductor.

Embodiment 14: The method as in any prior embodiment wherein the system is fired multiple times for one movement operation.

Embodiment 15: The method as in any prior embodiment wherein the multiple firings are in rapid succession producing a longer acting magnetic pressure than a single firing.

Embodiment 16: The method as in any prior embodiment wherein e multiple firings are in rapid succession producing a ramping magnetic pressure Embodiment 17: A method for moving a workpiece in a magnetic pressure system comprising tuning one or more of a resistor, capacitor or inductor of the system to adjust a phase angle of a magnetic pressure produced in the system.

Embodiment 18: The method as in any prior embodiment wherein the pressure signal is negative.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An arrangement for accelerating a workpiece comprising:

a system inductor configured to be supplied a current;

the workpiece positioned magnetically proximate to the system inductor;

a workpiece inductor associated with the workpiece and configured to magnetically interact with the system inductor wherein the workpiece inductor is configured with an RLC or RL or RC circuit to form a workpiece subsystem.

2. The arrangement as claimed in claim 1 wherein the RLC or RL or RC is passive.

3. The arrangement as claimed in claim 1 wherein the RLC or RL or RC is powered.

4. The arrangement as claimed in claim 1 wherein the system inductor is configured with an RLC or RL or RC circuit.

5. The arrangement as claimed in claim 1 wherein the system inductor is configured with an RLC or RL or RC circuit.

6. The arrangement as claimed in claim 1 wherein the workpiece inductor increases inductance of the workpiece subsystem.

7. The arrangement as claimed in claim 1 wherein the workpiece is a downhole tool.

8. The arrangement as claimed in claim 7 wherein the downhole tool is one of a liner hanger, casing patch, screen, fishing tool, collar, coupling, anchor, ball seat, frac plug, bridge plug and packer.

9. The arrangement as claimed in claim 1 wherein the workpiece is positioned relative to the system inductor to move radially.

10. The arrangement as claimed in claim 1 wherein the workpiece is positioned relative to the system inductor to move axially.

11. A method for moving a workpiece in a magnetic pressure arrangement comprising increasing inductance of a workpiece subsystem of the arrangement by disposing a workpiece inductor at the workpiece; and adjusting a natural frequency of the workpiece subsystem by changing one or more of capacitance, resistance or inductance of an RLC or RL or RC circuit electrically connected with the workpiece subsystem.

12. The method as claimed in claim 11 further including adding an RLC or RL or RC circuit to a system inductor.

13. The method as claimed in claim 11 wherein the system is fired multiple times for one movement operation.

14. The method as claimed in claim 13 wherein the multiple firings are in rapid succession producing a longer acting magnetic pressure than a single firing.

15. The method as claimed in claim 13 wherein the multiple firings are in rapid succession producing a ramping magnetic pressure.

16. A method for moving a workpiece in a magnetic pressure system comprising tuning one or more of a resistor, capacitor or inductor of the system to adjust a phase angle of a magnetic pressure produced in the system, wherein a workpiece inductor is configured with an RLC or RL or RC circuit to form a workpiece subsystem.

17. The method as claimed in claim 16 wherein the pressure signal is negative.

* * * * *